US007287752B2

(12) United States Patent
Barry

(10) Patent No.: US 7,287,752 B2
(45) Date of Patent: Oct. 30, 2007

(54) SIMULATED GOLF GAME

(75) Inventor: Stefan C. Barry, Greenfield, MA (US)

(73) Assignee: Box of Golf, Inc., Southampton, MA (US)

( * ) Notice: Subject to any disclaimer, the term of this patent is extended or adjusted under 35 U.S.C. 154(b) by 206 days.

(21) Appl. No.: 10/136,027

(22) Filed: Apr. 30, 2002

(65) Prior Publication Data

US 2003/0006552 A1 Jan. 9, 2003

Related U.S. Application Data

(60) Provisional application No. 60/287,301, filed on Apr. 30, 2001.

(51) Int. Cl.
*A63F 3/00* (2006.01)

(52) U.S. Cl. ..... 273/245; 273/255

(58) Field of Classification Search ..... 273/243, 273/244, 245, 259, 277, 312.2
See application file for complete search history.

(56) References Cited

U.S. PATENT DOCUMENTS 3,857,568 A * 12/1974 Yoder ..... 273/245
4,042,246 A * 8/1977 Strandgard ..... 273/245
4,781,384 A * 11/1988 Bois ..... 273/285
5,518,248 A 5/1996 Lightfoot
5,692,751 A 12/1997 Morrissey et al.
5,722,659 A 3/1998 Gluth
5,924,693 A 7/1999 Beaumier et al.
6,105,963 A 8/2000 Dontfraid
6,419,229 B1 7/2002 Whittington et al.

* cited by examiner

*Primary Examiner*—Vishu K. Mendiratta
(74) *Attorney, Agent, or Firm*—James F. McLaughlin

(57) ABSTRACT

A system of simulated golf play and a simulated golf game are described, wherein a player piece is moved along at least one path of play from a tee area, across a fairway and to a putting area, wherein said path of play is defined by indicia marking a ball path, and wherein the at least one path of play traverses at least one of a hill, a rough, a water hazard, a tree hazard, and a sand trap hazard and wherein a plurality of player chips are collected and redeemed, wherein at least one of the player chips represent both a point award and at least permissible special actions of a player or special effects on a ball.

1 Claim, 4 Drawing Sheets

SIMULATED GOLF GAME

CROSS REFERENCE TO RELATED APPLICATIONS

This application claims the benefit of priority to U.S. Provisional Patent Application Ser. No. 60/287,301, filed Apr. 30, 2001, the entire contents of which are specifically incorporated herein by reference.

BACKGROUND

The game of golf generally involves moving a small, hard ball through a series of nine or eighteen holes, which generally comprise a tee zone, a fairway and a putting zone, which includes a cup. The direction and contours of the holes provide depth to each hole. Additionally, the provision of hazards, e.g., water or sand hazards, within the contouring of the holes provides the game with varying degrees of technical difficulty.

In the past, avid players have attempted to simulate the game of golf using boards and player pieces. For example, U.S. Pat. No. 6,105,963 to Dontfraid describes a system of simulated play emphasizing club selection. A random roll of a windage die and random rolls of up to three conventional dice determine distance and drift of a player chit as it moves sequentially forward or sideways across a series of holes, each hole defined with a matrix of boxes (potential ball positions).

U.S. Pat. No. 5,924,693 to Beaumier et al. describes a system of simulated play, wherein movement of a character down a fairway occurs by random selection of a card in the player's possession, the card indicating direction and displacement. For play on the putting green, various dice are used depending on a player's distance from the cup.

U.S. Pat. No. 5,722,659 to Gloth describes a system of simulated play using dice to determine the distance and direction of a shot. A spinner determines the number of putting strokes taken during putting.

U.S. Pat. No. 5,692,751 to Morrissey et al. describes a system of simulated play utilizing trivia cards and club selection cards to determine how the player moves through holes.

U.S. Pat. No. 5,518,248 to Lightfoot describes a system of simulated play, wherein a deck of cards determines the outcome of any particular shot from a plurality of possible outcomes.

While different board games and different systems of simulated play have been attempted in the past, there is great room for improvement. Accordingly, there is a need in the art for a clever and unique board game and method of simulated play as described by the present disclosure.

SUMMARY

The above discussed and other drawbacks and deficiencies of the prior art are overcome or alleviated by the present system of simulated golf play and a simulated golf game, wherein a player piece is moved along at least one path of play from a tee area, across a fairway and to a putting area, wherein said path of play is defined by indicia marking a ball path, and wherein the at least one path of play traverses at least one of a hill, a rough, a water hazard, a tree hazard, and a sand trap hazard and wherein a plurality of player chips are collected and redeemed, wherein at least one of the player chips represent both a point award and at least permissible special actions of a player or special effects on a ball.

The above discussed and other features and advantages of the present simulated golf game will be appreciated and understood by those skilled in the art from the following detailed description and drawings.

BRIEF DESCRIPTION OF THE DRAWINGS

Referring now to the drawings, wherein like elements are numbered alike in the several FIGURES.

DETAILED DESCRIPTION OF EXEMPLARY EMBODIMENTS

Reference will now be made in detail to the exemplary embodiments of the present simulated golf game, examples of which are illustrated in the accompanying drawings. The present disclosure provides a board game designed to simulate the game of golf.

Figure 1:
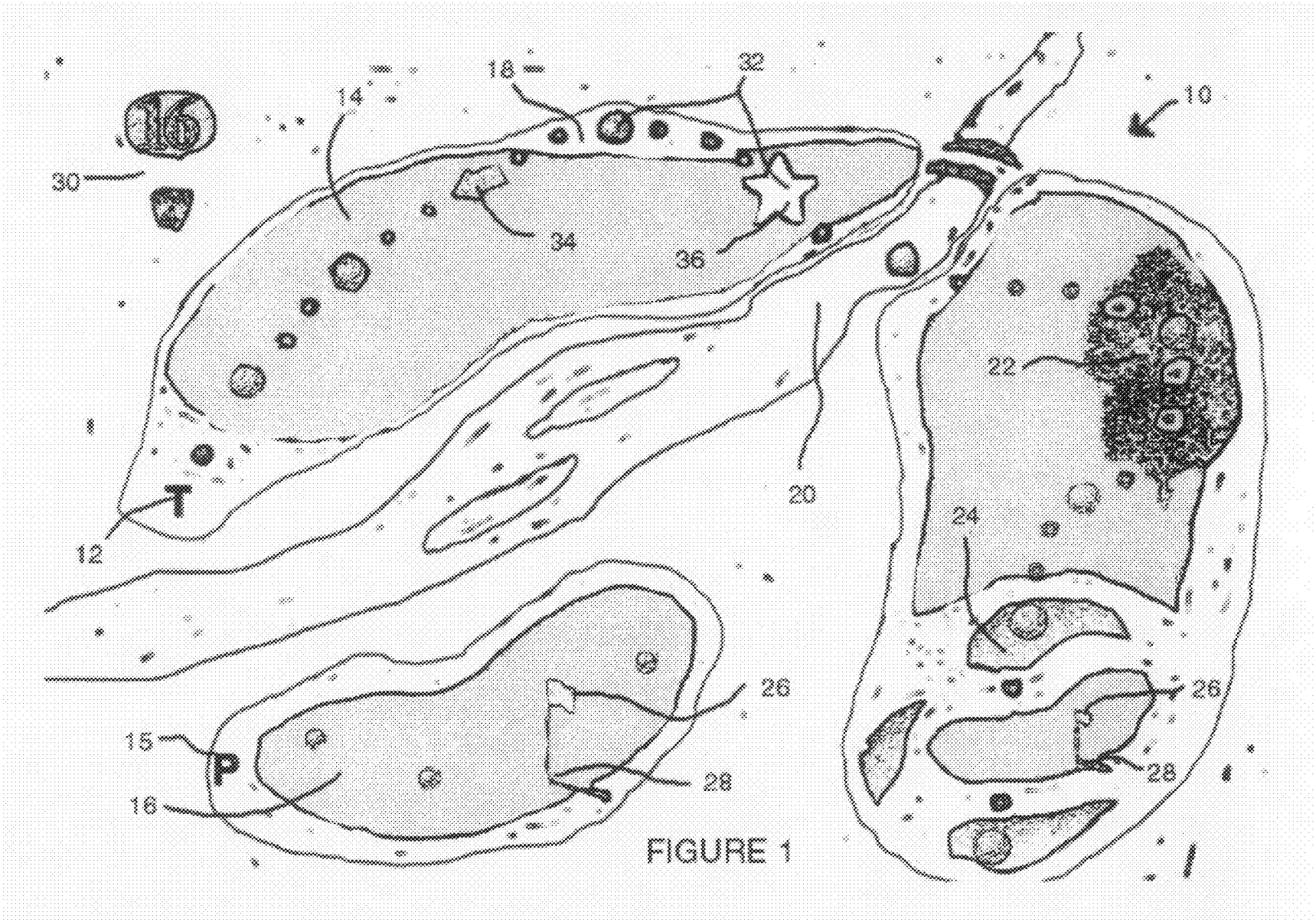
FIG. 1 depicts in perspective view an exemplary simulated hole of golf.

Referring now to FIG. 1, a perspective view of an exemplary hole of golf is illustrated generally at 10. The illustrated exemplary hole comprises a tee area 12, a fairway area 14 and a putting area 16. In the illustrated exemplary hole, the putting area 16, or green, is reproduced in an enlarged illustration providing greater detail for simulated play on the putting area 16. A starting position for the enlarged putting area 16 is illustrated generally at 15. The exemplary hole also illustrates exemplary hazards, including rough areas 18 around the fairway 14, a water hazard 20 in the form of a river crossing the fairway 14, trees 22 in a shot path, and sand traps, or bunkers 24. A flag 26 is positioned in a cup 28 on the putting area 16.

The illustrated exemplary hole is also identified by a marking 30 indicating hole number and the difficulty of the hole. Additionally, at least one path of play is indicted by a series of ball position indicators 32. Other indicators in the path of ball play may also be included, as will be described below with reference to an exemplary system of simulated play. For example, hills or sloped regions of the hole may be indicated by one or more arrows 34. Also, particularly desirable lies along the hole may be indicated, for example, by a star 36.

In one exemplary embodiment, each hole is printed on a separate board or on a separate side of a series of boards. For example, a single board may show Hole 1 on a first side and Hole 10 on a second side. Thus, as will be described in more detail below with reference to the configuration of the storage box 40, each of Holes 1-18 may be played in organized succession. In one embodiment, a player or set of players completes Hole 1, removes the board from the stack of boards, flips the board to show Hole 10 and inserts the board underneath the stack of boards such that Hole 10 follows Hole 9. In such a way, an entire 18 holes may be played in organized fashion. The exemplary storage box 40 described below may be used to facilitate such organized play.

Figure 2:
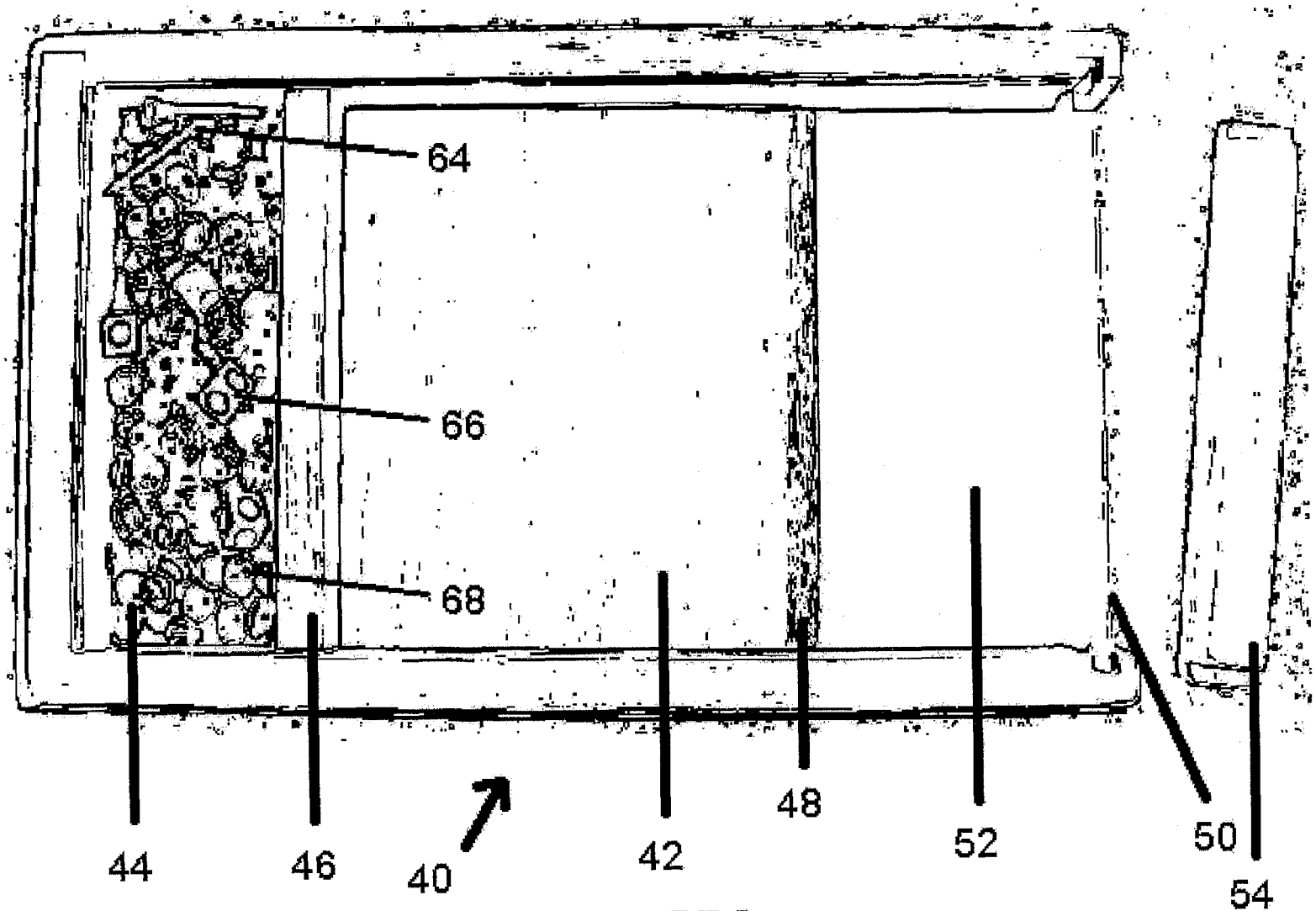
FIG. 2 depicts in top view an exemplary storage box with stored playing pieces.

Referring to FIG. 2, in another exemplary embodiment, to facilitate game play, the boards are stored in a storage box, shown generally at 40. The exemplary storage box generally comprises a first storage area 42 for storing a plurality of playing boards 10 and at least one additional storage area 44 for storage of a plurality of game pieces. In one embodiment, the storage box 40 is rectangular in overall shape, and storage areas 42 and 44 are divided by partition 46. The divider wall may optionally include one or more recesses or notches (not shown) to permit facile removal of the top board of a stack of boards.

Referring still to the exemplary embodiment illustrated by FIG. 2, a sloped surface 48 is provided on the upper surface of the bottom of the first storage area 42. The sloped surface 48 is strategically placed, such that it will facilitate insertion of a used board 10 underneath a stack of boards. As the used board 10 is inserted into the first storage area 42 from a first side 50 of the bottom of the first storage area 42, the board leverages against the bottom of the stack of boards, the sloped surface 48 and, to some extent, the first side 50 of the bottom of the first storage area 42 to facilitate insertion of the used board 10 underneath the stack. When the used board is in position underneath the stack of boards, the sloped surface 48 creates an open space 52 defined by the lower surface of the board 10, the sloped surface 48 and the first side 50 of the bottom of the first storage area 42. This open space 52 also facilitates insertion of additional boards.

Referring still to the exemplary storage box illustrated by FIG. 2, the storage box 40 also comprises a movable or removable side wall 54 positioned near the first side 50 of the bottom of the storage area 42. The movable side wall 54 may generally be configured to disengage from the storage box 40 such that a plurality of boards may be added to or removed from the first storage space 42. In one embodiment, the movable side wall 54 is generally configured to slide in a plane tangent to the bottom of the first storage area 42. In such an embodiment, the movable side wall may be minimally displaced to allow insertion of one or more boards between the movable side wall 54 and the first side 50 of the bottom of the first storage area 54.

Figure 3:
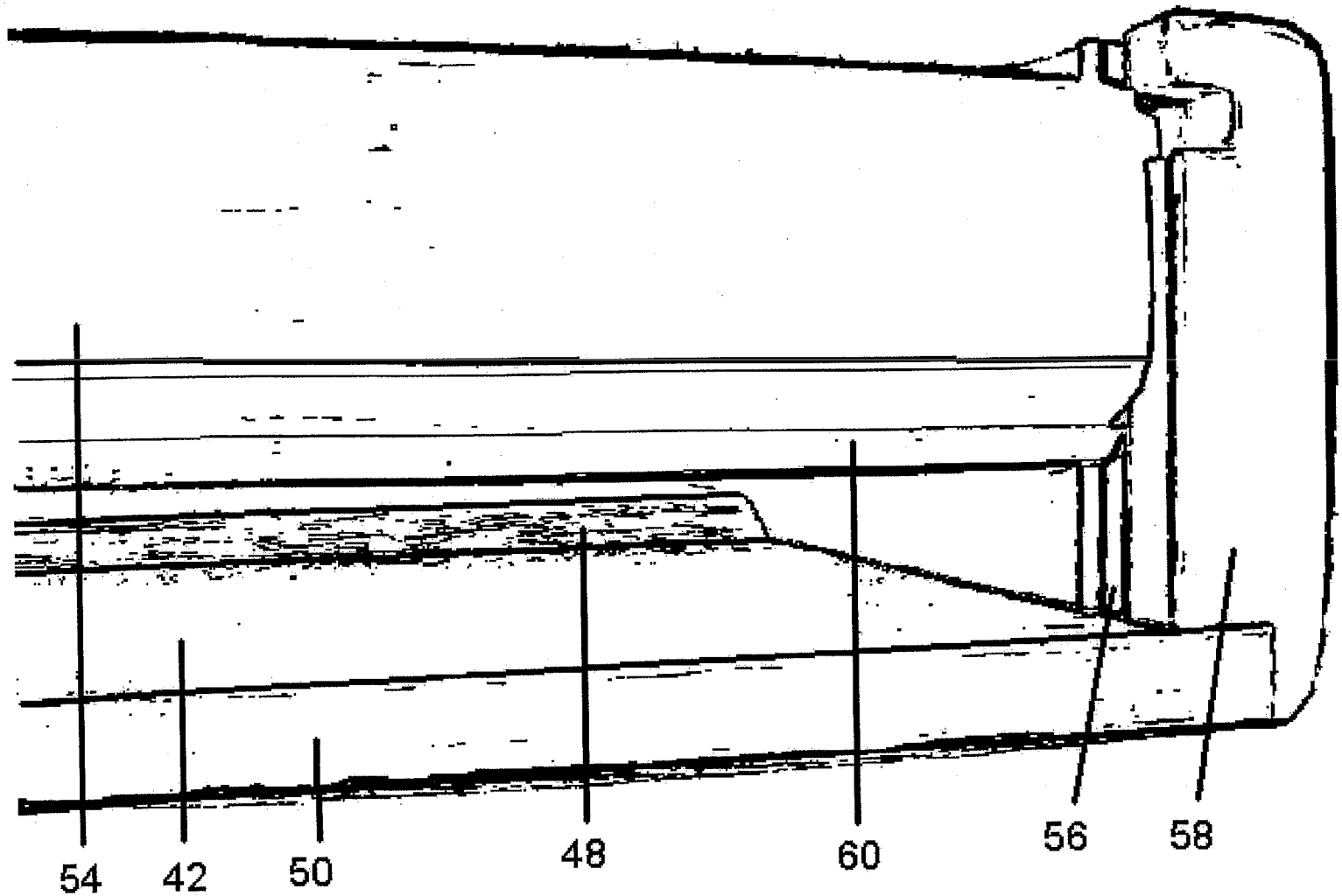
FIG. 3 depicts a side view of an exemplary storage box with a movable side.
Figure 4:
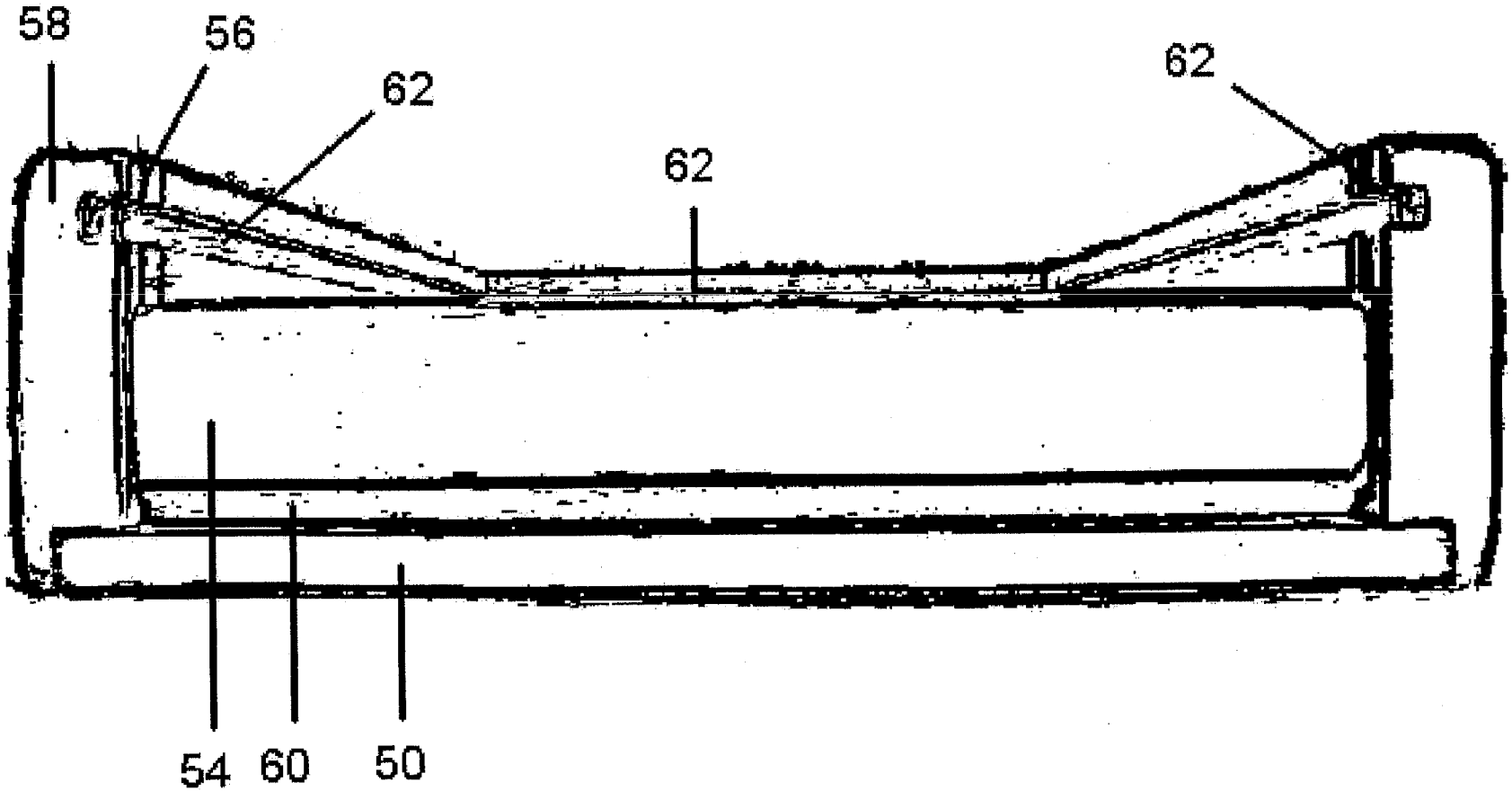
FIG. 4 depicts another side view of an exemplary storage box with a movable side.

Referring now to FIG. 3, an exemplary movable side wall 54 is illustrated in greater detail. The illustrated exemplary movable side wall 54 is generally configured to move in a plane parallel to the first side 50 of the bottom of the first storage area 42. The illustrated movable side wall 54 is configured to slide within a groove 56 provided within a non-moving wall 58 of the storage box 40. In another embodiment, the movable side wall 54 includes an angled region 60, which is generally configured to leverage the movable side wall 54 away from the bottom of the first storage area 42 when a board 10 is pressed against the angled region 60. In such an embodiment, a user need only press a used board against the angled region 60 and continue pressing against the board as the board travels past the sloped surface 48 and into position underneath a stack of boards.

Referring now an exemplary storage box as illustrated by FIG. 3, an additional groove 62 may be provided near the upper periphery of the storage box 40, wherein the additional groove 62 may be configured to slidably receive a lid or top piece (not shown) therein. In an exemplary embodiment, the top piece or lid includes printed and/or illustrated instructions for game play. In another embodiment, the lid or top piece includes a lid handle. In such an embodiment, a player may easily grasp the lid by the handle, slidably remove the lid and begin game play.

With reference to FIG. 2, additional components of the exemplary board game may include player pieces 64, e.g., differently colored golf tees or other pieces, and a series of identical dice 66, each die having differently colored sides thereon. It should be recognized that while identical dice having differently colored sides are described, the present disclosure contemplates use of different dice or dice having differently numbered sides thereon.

Additionally, a series of action chips 68 may be provided and played to affect the progression of game play. For example, in one embodiment a blue colored chip is provided to indicate the effect of wind on a particular shot. In such an embodiment, a player may give up a blue colored chip to move the player's ball (represented by the player piece) forward or backwards one space on the fairway 14, in the rough 18 or around hazards 20, 22, 24. In another embodiment, a red colored chip may be played in a similar fashion to redo an entire turn or shot (a "mulligan") made on the fairway 14, in the rough 18 or around hazards 20, 22, 24. In another embodiment, a yellow colored chip may be played in a similar fashion to induce backspin on the ball, for example, when playing onto the green 16 from the fairway 14, the rough 18 or from hazards 20, 22, 24 such that the ball may be positioned closer to the cup 28. In another embodiment, a green colored chip may be played in similar fashion to ensure that a put on the green 16 will fall into the cup 28 (a "gimmee").

Having described exemplary gaming components and pieces of the present simulated golf game, a description of an exemplary system of game play will follow. An exemplary system of game play will follow with reference to the exemplary hole illustrated by FIG. 1.

With reference to FIG. 1, exemplary game play begins with each player piece 64 positioned on the tee area 12. The objective of the game may be to complete a predetermined number of holes and retaining or earning the greatest number of chips 68. In an exemplary embodiment, each player may begin with a predetermined number of chips 68, for example four chips, each of a different color.

As described above, each chip 68 may have an action or effect associated with that chip's color, and players may redeem certain chips on playing a shot to affect the outcome of that shot. In one embodiment, a player must decide whether to play a chip prior to ending a turn. To play a chip, a player loses the chip and may return it to the second storage area 44. In another embodiment, each player may only play one chip 68 per turn. In another embodiment, each player may draw chips from the second storage area 44 at the start of each hole to ensure a minimum stash of at least four. In another embodiment, selection of chips subsequent to the start of the game is done at random (without reference to color).

Referring still to FIG. 1, each player begins the tee by 'choosing a club', which may mean selecting the number of dice 66 that player intends to roll simultaneously. In one embodiment, a maximum of five dice may be played simultaneously. In another embodiment, a player may re-roll one or more of the played dice until a maximum number of dice are matching, or until three rolls are played, whichever comes first. In another embodiment, each die 66 is six sided and shows six different colors on each side, for example, black, red, blue, green, yellow and purple.

In another embodiment, the position of the player piece 64 (i.e., the player's lie) determines the maximum number of dice that may be played (i.e., the lie affects the club selection). For example, in one embodiment, a maximum of five dice may be played from the tee, a maximum of four dice may be kept out of a roll of five dice on the fairway. In another embodiment, a maximum of four dice may be played from the rough or from a tree.

Thus, in one embodiment, a player chooses from the dice 66 rolled one color to keep and collect, the object being to collect as many of the dice of one color as possible. After a color is chosen, a player may re-roll the remaining non-matching dice in an attempt to collect more matching dice. In another embodiment, players may switch colors at any time, as long as the switch does not reduce the number of matching dice earned. After all rolls, the player then should move the player piece 64 the number of position indicators 32 corresponding to the number of matching dice.

In another exemplary embodiment, one preselected die color, for example black, has no space value and may not be re-rolled for the remainder of a player's term. In another exemplary embodiment, an exception is made for the preselected die color (e.g., black), wherein the preselected die color may be re-rolled and may have space value when a player is shooting from the tee area 12.

In another exemplary embodiment, a second preselected die color, for example purple, is a wild color. In such an embodiment, a wild roll counts as a space, may be matched with any color and must be used when the player moves the player piece.

Thus, with reference to FIG. 1, in an exemplary embodiment where a player tees off with three matching dice 66, that player moves three spaces to arrow 34. Without playing a chip, the player would roll backwards down a hill in the direction of the arrow to the preceding position marker 32. However, the player may also choose to play a chip 68. For example, the player may redeem a blue ("wind") chip to push the initial shot past the arrow 34 into the rough 18 around the next position marker 32. In the alternative, a player may redeem a red ("mulligan") chip and restart that player's turn ("shot"). The player proceeds down the fairway in such a fashion until that player lands on the green.

In another exemplary embodiment, one or more of the following rules may be associated with the contouring or hazards of the hole:

In the sand trap hazard 24 (or "bunker"), wild rolls do not count when hitting out of the sand.

In the rough 18, one space must be subtracted from the final roll when hitting out of the rough (i.e., a four of a kind roll is reduced to a three of a kind roll). Optionally, wilds may be re-rolled with other non-matching dice when in the rough.

If a shot lands in the water 20, one penalty stroke is assessed and the next turn must be played from the original space, or from the dry land position marker 32 closest to the water and not nearer to the hole (if the closest dry land position marker 32 is an arrow, then it may optionally be treated as a good fairway lie and not a slope).

When a player has a tree 22 in the path of their shot (i.e., a shot from one position marker 32 to another position marker 32 with a tree 22 in between), that player must take a "tree test." To do this, a player may take a die and roll it once. If the die does not land on a preselected color or other indicator, e.g., a black color, then the player passes and may move on past the tree 22 the number of spaces corresponding to the intended target. However, if the preselected color is rolled, then the shot stops at the tree (i.e., hits the tree). Optionally, wind chips may not be allowed during the players turn subsequent to a tree test. Additionally, as a player hits from a tree to another target, the rules of the rough 18 may be applied.

When a player lands on a star 36, a player is rewarded for a great shot. A player may select one chip 68 at random. Additionally, players hitting from a star 36 may use the rules of hitting from the tee 12.

As indicated by FIG. 1, a player may overshoot a green 16 and potentially land in a hazard. Additionally, a player may redeem a backspin chip 68 when landing on a green 16. The backspin chip will ensure that the ball spins close or into the hole. In one embodiment, to determine the lie on the green 16, a player may take up to five dice and roll them once. In another embodiment, only a preselected color or indicator will count, for example wild rolls, and the number of the preselected color or indicator will determine how close to the flag 26 the ball will lie. In another embodiment, when a player lands on a green without using a chip 68 and/or without using any wild dice (i.e., a natural shot), that player is entitled to a free backspin roll.

Once all players land on the green 16, game play may move to the enlarged putting area 16. In one exemplary embodiment, each player begins the put on the starting position 15. A player may roll the dice as usual to attempt to get the ball (player piece 64) into the cup 28. Each space immediately next to the cup 28 may be considered a "tap in", meaning that a player may not miss from so close, and therefore need not roll the dice, but must add the stroke as usual.

Once a player "holes out", the player may add up the number of strokes and collect reward chips. In one embodiment, players are awarded one chip for each stroke under par after completing a hole. (i.e., a birdie earns one chip and an eagle earns two chips). Two chips may also be awarded outright to the winner of a hole. Additionally, ties may be rewarded with a split of the winner chips (In games of three or more players, ties may be rewarded with one chip each).

Thus, according to the above, the present simulated golf game advantageously recreates certain technical aspects of the golf game by playing on the contouring effects of a tee, the fairway, the surrounding rough, the green or the hazards and granting the player the ability to gauge the course and plan each shot accordingly. Provision of the chips 68 and the actions they represent allow the player to play in either an aggressive or a cautious manner, particularly in light of the fact that the game may be won or lost according to each player's ability to retain and collect the action chips 68. Additionally, the arrangement of the elements, contours and hazards of each hole or course provide a flexibility that will allow the designer of the game to either independently construct fictional holes or to design game play according to the technical challenges existing on particular famous holes or courses, for example competition courses.

It will be apparent to those skilled in the art that, while exemplary embodiments have been shown and described, various modifications and variations can be made in the present simulated golf game without departing from the spirit or scope of the invention. Accordingly, it is to be understood that the various embodiments have been described by way of illustration and not limitation.

What is claimed is:

1. A simulated golf game, comprising:

at least one game board, the game board, wherein the game board indicates by illustration a tee area, a fairway area, a putting area and at least one path of play defined by indicia marking a ball path, and wherein the at least one path of play traverses at least one of a hill, a rough, a water hazard, a tree hazard, and a sand trap hazard;

at least one player piece;

a plurality of player chips, wherein at least one the player chips represent both a point award and at least permissible special actions of a player or special effects on a ball;

further comprising a storage box housing the at least one game board, wherein said storage box comprises a first storage area for storing a plurality of game boards, and wherein said first storage area includes at least one movable or removable side;

wherein the bottom of said first storage area includes a sloped region, and wherein the bottom region of said first storage area nearer to the movable or removable side is lowered relative to the bottom region more distant relative to the movable or removable side.

* * * * *